US008905128B2

(12) United States Patent
Niconoff

(10) Patent No.: US 8,905,128 B2
(45) Date of Patent: Dec. 9, 2014

(54) VALVE ASSEMBLY EMPLOYABLE WITH A DOWNHOLE TOOL

(75) Inventor: Mijail Barranco Niconoff, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 792 days.

(21) Appl. No.: 12/839,788

(22) Filed: Jul. 20, 2010

(65) Prior Publication Data

US 2012/0018147 A1 Jan. 26, 2012

(51) Int. Cl.
*E21B 47/00* (2012.01)
*E21B 49/10* (2006.01)

(52) U.S. Cl.
CPC ..... *E21B 49/10* (2013.01)
USPC ..... 166/250.01; 166/332.8; 166/332.4; 166/264

(58) Field of Classification Search
CPC ..... E21B 47/00; E21B 47/06; E21B 47/09; E21B 47/12; E21B 49/00; G01L 9/00; G01K 7/00
USPC ..... 166/250.01, 53, 264, 316, 255.1, 332.8, 166/334.2; 73/152.18, 152.22, 152.24, 73/152.27, 152.28, 152.25
See application file for complete search history.

(56) References Cited

U.S. PATENT DOCUMENTS

| | | | | |
|---|---|---|---|---|
| 4,994,671 | A | 2/1991 | Safinya et al. | |
| 5,166,747 | A | 11/1992 | Schroeder et al. | |
| 5,433,276 | A | 7/1995 | Martain et al. | |
| 5,939,717 | A | 8/1999 | Mullins | |
| 5,956,132 | A | 9/1999 | Donzier | |
| 6,092,416 | A | 7/2000 | Halford et al. | |
| 6,174,001 | B1 | 1/2001 | Enderle | |
| 6,397,946 | B1 | 6/2002 | Vail, III | |
| 6,595,487 | B2 | 7/2003 | Johansen et al. | |
| 6,641,434 | B2 | 11/2003 | Boyle et al. | |
| 6,851,481 | B2 | 2/2005 | Vinegar et al. | |
| 6,986,282 | B2 | 1/2006 | Ciglenec et al. | |
| 7,114,562 | B2 | 10/2006 | Fisseler et al. | |
| 7,231,971 | B2 * | 6/2007 | McCalvin | 166/250.01 |
| 7,243,536 | B2 * | 7/2007 | Bolze et al. | 73/152.24 |
| 2003/0164240 | A1 * | 9/2003 | Vinegar et al. | 166/372 |
| 2004/0060703 | A1 * | 4/2004 | Stegemeier et al. | 166/310 |
| 2008/0275594 | A1 | 11/2008 | de Guzman | |
| 2009/0025926 | A1 | 1/2009 | Briquet et al. | |
| 2011/0042070 | A1 * | 2/2011 | Hsu et al. | 166/250.01 |

FOREIGN PATENT DOCUMENTS

| | | |
|---|---|---|
| EP | 1921250 | 5/2008 |

* cited by examiner

*Primary Examiner* — Yong-Suk (Philip) Ro

(74) *Attorney, Agent, or Firm* — Cathy Hewitt

(57) ABSTRACT

A valve assembly employable with a downhole tool configured for conveyance in a wellbore extending into a subterranean formation and method of operating the same. The valve assembly includes an actuator and a sensing apparatus configured to provide a first signal based on an environment associated with the valve assembly and a second signal based on a characteristic of the valve assembly. The valve assembly also includes a controller configured to provide a third signal to the actuator to alter the characteristic in response to the first and second signals.

14 Claims, 13 Drawing Sheets

VALVE ASSEMBLY EMPLOYABLE WITH A DOWNHOLE TOOL

BACKGROUND OF THE DISCLOSURE

Wells are generally drilled into the ground or ocean bed to recover natural deposits of oil and gas, as well as other desirable materials that are trapped in geological formations in the earth's crust. A well is drilled into the ground and directed to the targeted geological location from a drilling rig or platform at the surface of the earth. The well may be formed using a drill bit attached to the lower end of a drill string formed with a plurality of drill pipe (or drill pipe collars). Drilling fluid, or mud, is typically pumped down through the drill string to the drill bit. The drilling fluid lubricates and cools the drill bit, and carries drill cuttings back to the surface in the annulus between the drill string and a wellbore wall.

For successful oil and gas exploration, it is advantageous to have information about the subterranean formations that are penetrated by a wellbore. For example, one aspect of standard formation testing relates to the measurements of the formation pressure and formation permeability. Another aspect of standard formation testing relates to the extraction of formation fluid for fluid characterization, in situ or in surface laboratories. These measurements are useful to predicting the production capacity and production lifetime of a subterranean formation.

Well logging tools are devices configured to move through a wellbore drilled through subterranean formations. The well logging tools include one or more devices that measure various properties of the subterranean formations and/or perform certain mechanical acts on the formations, such as drilling or percussively obtaining samples of the subterranean formations, and withdrawing samples of connate fluid from the subterranean formations. Measurements of the properties of the subterranean formations may be recorded with respect to a tool axial position (depth) within the wellbore as the tool is moved along the wellbore. Such recording is referred to as a well log.

Well logging tools (or tools in general) can be conveyed along the wellbore by extending and withdrawing an armored electrical cable ("wireline"), wherein the well logging tools are coupled to the end of the wireline. Extending and withdrawing the wireline may be performed using a winch or similar spooling device known in the art. However, such conveyance relies on gravity to move the well logging tools into the wellbore, which are used on substantially vertical wellbores. Wellbores deviating from vertical may require additional force for conveyance through the wellbore. For examples of conveyance techniques, see, e.g., U.S. Pat. No. 5,433,276, issued to Martain, et al., entitled "Method and System for Inserting Logging Tools into Highly Inclined or Horizontal Boreholes," issued Jul. 18, 1995, and U.S. Pat. No. 6,092,416, issued to Halford, et al., entitled "Downhole System and Method for Determining Formation Properties," issued Jul. 25, 2000, which are incorporated herein by reference in their entirety.

To operate and perform desired tasks such as measuring local environmental parameters and sampling formation fluids, several types of downhole valves are widely used with downhole tools to seal, for instance, a wired drill pipe string (or more commonly referred to as a wired drill pipe ("WDP"), which is a type of drill string including a communication channel (see, e.g., U.S. Pat. No. 6,641,434, issued to Boyle, et al., entitled "Wired Pipe Joint with Current-loop Inductive Couplers," issued Nov. 4, 2003, which is incorporated herein by reference in its entirety). Most of these downhole valves are actuated electrically or hydraulically to switch between an open and a closed position, and these actuation tasks can initiate a sequence of sampling or measurement operations, processes, or very basic logic operations. The valves usually do not interact with an operator on the surface or the tool itself due to limited bandwidth of the communication channel coupled between the valve and surface computer system.

The harsh environment and very limited space within a downhole has not allowed introduction of more complex valves with feedback loops or extra electronics. To make things more difficult, the downhole valves by themselves can be unreliable, and can be the cause of day-to-day operational problems due to the limitations of space and the harsh working environment.

These limitations have now become substantial hindrances to safe and efficient drilling and measuring processes associated with forming and operating an oil or gas well. Thus, despite numerous product developments, no satisfactory strategy has emerged to overcome these limitations.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
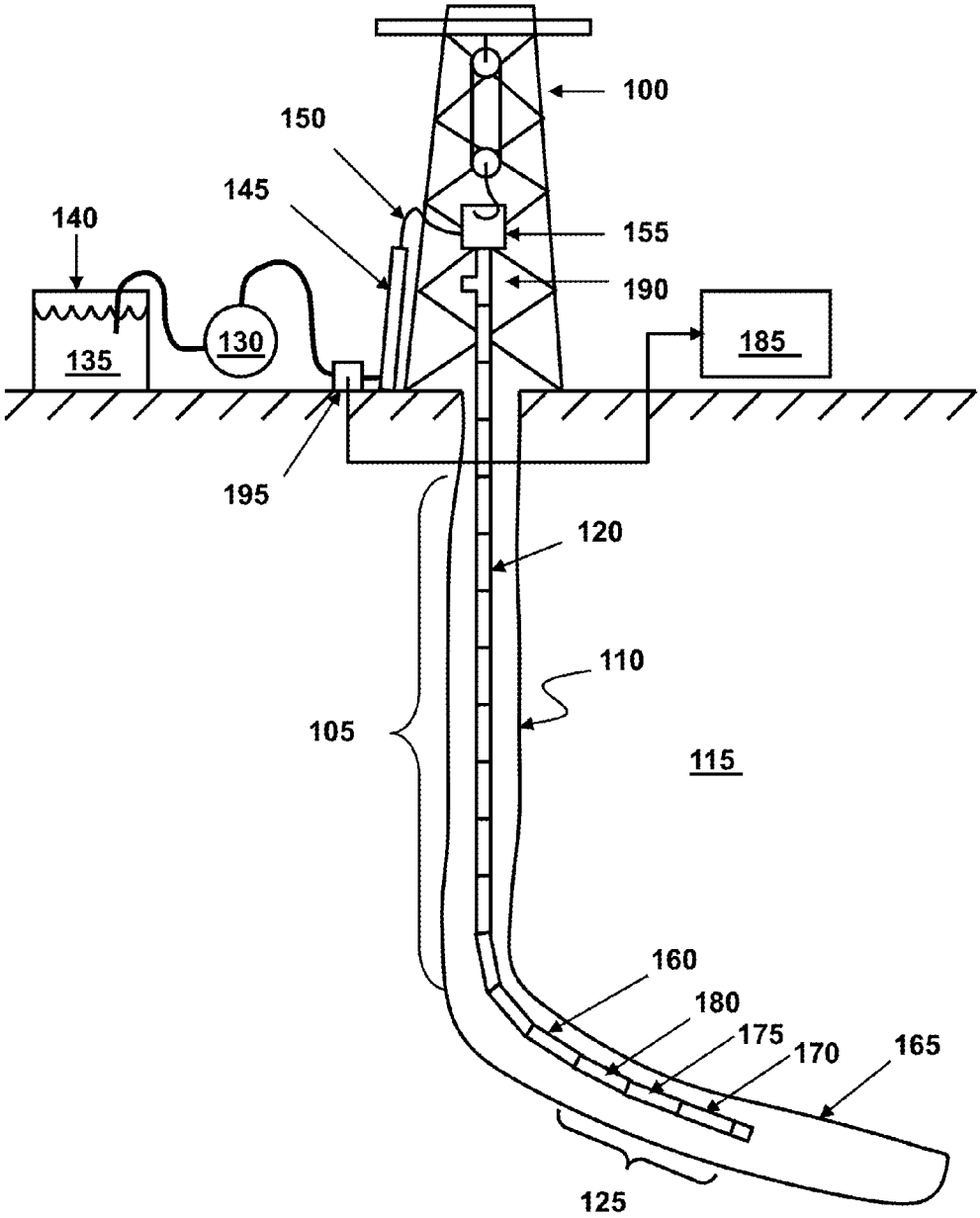
FIGS. 1 to 12 are schematic views of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

The apparatus and methods of the present disclosure will be described with respect to exemplary embodiments in a specific context, namely, a valve assembly (also referred as a valve or downhole valve) configured to respond autonomously to an environment associated with a characteristic of the valve assembly to alter the characteristic thereof. While one or more aspects of the present disclosure may be described in the environment of a wellbore, any downhole application that may benefit from a valve assembly as described herein is well within the broad scope of the present disclosure.

The valve assembly may be employed in the environment of a system and method for communicating between a surface computer system and a downhole tool or a "string" of such tools in a wellbore (also referred to as a borehole) using a wired drill pipe for conveyance and signal communication. The wired drill pipe string may be assembled and disassembled in segments to effect conveyance in a manner known in the art for conveyance of segmented drill pipes through a wellbore. While the valve assembly is described as used with tools commonly conveyed on a wireline ("wireline tools"), the valve assembly may be implemented with any other type of downhole tool such as logging while drilling ("LWD") tools.

Referring initially to FIG. 1, illustrated is a schematic view of apparatus according to one or more aspects of the present disclosure. The apparatus includes a drilling rig 100 or similar lifting device employable to move a wired drill pipe string 105 within a wellbore 110 that has been drilled through subterranean formations, shown generally at 115, that provides an environment for application of one or more aspects of the present disclosure. The wired drill pipe string 105 may be extended into the wellbore 110 by threadedly coupling together end to end a number of coupled drill pipes (one of which is designated 120) of the wired drill pipe string 105. The wired drill pipe string 105 may be structurally similar to ordinary drill pipes, as illustrated for example, in U.S. Pat. No. 6,174,001, issued to Enderle, entitled "Two-Step, a Low Torque, Wedge Thread for Tubular Connector," issued Aug. 7, 2001, which is incorporated herein by reference in its entirety, and includes a cable associated with each drill pipe 120 that serves as a communication channel. The cable may be any type of cable capable of transmitting data and/or signals, such as an electrically conductive wire, a coaxial cable, an optical fiber or the like.

The wired drill pipe string 105 typically includes some form of signal coupling to communicate signals between adjacent drill pipes when coupled end to end as illustrated. See, as a non-limiting example, the description of one type of wired drill pipe string having inductive couplers at adjacent drill pipes in U.S. Pat. No. 6,641,434. However, one or more aspects of the present disclosure are not limited to the wired drill pipe string 105 and can include other communication or telemetry systems, including a combination of telemetry systems, such as a combination of wired drill pipe string, mud pulse telemetry, electronic pulse telemetry, acoustic telemetry or the like.

The wired drill pipe string 105 may include one, an assembly, or a "string" of downhole tools at a lower end thereof. In the present example, the downhole tool string may include well logging tool(s) 125 coupled to a lower end thereof. As used in the present description, the term "well logging tool," or a string of such tools, means one or more wireline well logging tools that are capable of being conveyed through a wellbore 110 using armored electrical cable ("wireline"), logging while drilling tools, formation evaluation tools, formation sampling tools and/or other tools capable of measuring a characteristic of the subterranean formation 115 and/or of the wellbore 110.

Several of the components disposed proximate the drilling rig 100 may be used to operate components of the system. These components will be explained with respect to their uses in drilling the wellbore 110 for a better understanding thereof. The wired drill pipe string 105 may be used to turn and axially urge a drill bit into the bottom of the wellbore 110 to increase its length (depth). During drilling of the wellbore 110, a pump 130 lifts drilling fluid ("mud") 135 from a tank 140 or pit and discharges the mud 135 under pressure through a standpipe 145 and flexible conduit 150 or hose, through a topdrive 155 and into an interior passage (not shown separately in FIG. 1) inside the wired drill pipe string 105. The mud 135, which can be water- or oil-based, exits the wired drill pipe string 105 through courses or nozzles (not shown separately) in the drill bit, where it then cools and lubricates the drill bit and lifts drill cuttings generated by the drill bit to the surface of the earth.

When the wellbore 110 has been drilled to a selected depth, the wired drill pipe string 105 may be withdrawn from the wellbore 110. An adapter sub 160 and the well logging tools 125 may then be coupled to the end of the wired drill pipe 105, if not previously installed. The wired drill pipe string 105 may then be reinserted into the wellbore 110 so that the well logging tools 125 may be moved through, for example, a highly inclined portion 165 of the wellbore 110, which would be inaccessible using armored electrical cable ("wireline") to move the well logging tools 125. The well logging tools 125 may be positioned on the wired drill pipe string 105 in other manners, such as by pumping the well logging tools 125 down the wired drill pipe string 105 or otherwise moving the well logging tools 125 down the wired drill pipe 105 while the wired drill pipe string 105 is within the wellbore 110.

During well logging operations, the pump 130 may be operated to provide fluid flow to operate one or more turbines (not shown in FIG. 1) in the well logging tools 125 to provide power to operate certain devices in the well logging tools 125. However, when tripping in or out of the wellbore 110, it may be infeasible to provide fluid flow. As a result, power may be provided to the well logging tools 125 in other ways. For example, batteries may be used to provide power to the well logging tools 125. In one embodiment, the batteries may be rechargeable batteries that may be recharged by turbine(s) during fluid flow. The batteries may be positioned within a housing of one or more of the well logging tools 125. Other manners of powering the well logging tools 125 may be used as appreciated by those having ordinary skill in the art.

As the well logging tools 125 are moved along the wellbore 110 by moving the wired drill pipe string 105 as explained above, signals may be detected by various devices, of which non-limiting examples may include a resistivity measurement device 170, a gamma ray measurement device 175 and a formation fluid sample chamber module 180, which may include a formation fluid pressure measurement device (not shown separately). The signals may be transmitted toward the surface of the earth along the wired drill pipe string 105.

When tripping in and out of the wellbore 110 or performing another process wherein drill pipe 120 is being added, removed or disconnected from the wired drill pipe string 105, it may be beneficial to have an apparatus and system for communicating from the wired drill pipe string 105 to a surface computer system 185 or other component configured to receive, analyze, and/or transmit data. Accordingly, a second adapter sub 190 may be coupled between an end of the wired drill pipe string 105 and the topdrive 155 that may be employed to provide a wired or wireless communication channel or path with a receiving unit 195 for signals received from the well logging tools 125. The receiving unit 195 may be coupled to the surface computer system 185 to provide a data path therebetween that may be a bidirectional data path.

Figure 2:
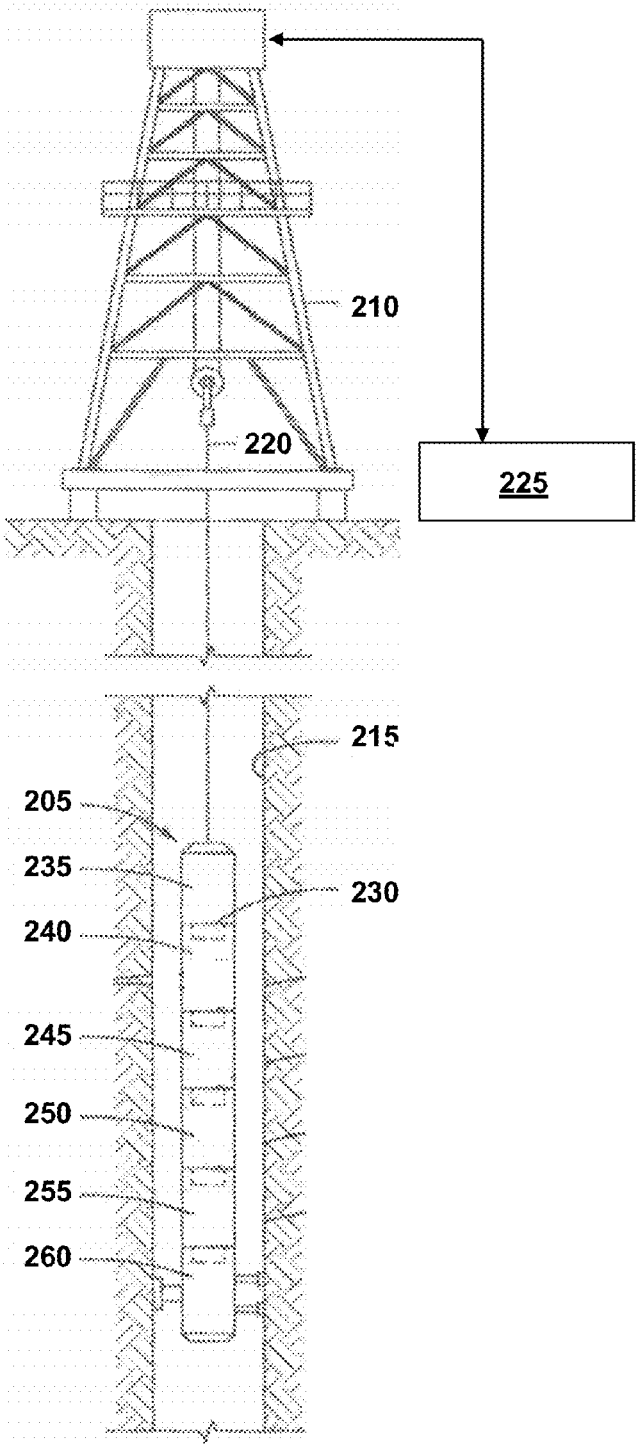

Referring to FIG. 2, illustrated is a schematic view of apparatus according to one or more aspects of the present disclosure. The apparatus includes a wireline tool 205 deployed from a drilling rig 210 that provides an environment for application of one or more aspects of the present disclosure. Alternatively, the wireline tool 205 may be directly deployed from a truck without utilizing the drilling rig 210. The wireline tool 205 is suspended in a wellbore 215 from the lower end of a wireline (e.g., multi-conductor cable) 220 that is spooled on a winch supported by the drilling rig 210. At the surface, the wireline 220 is communicatively coupled to a computer system (including a processor, etc.) 225.

The wireline tool 205 may be lowered into the wellbore 215 using the wireline 220 as is well known in the art. The wellbore 215 traverses a reservoir or subterranean formation. The wireline tool 205 includes several modules connected by field joints (one of which is designated 230). In the illustrated embodiment, the wireline tool 205 includes an electronics module 235, a sample chamber module 240, a first pump-out module 245, a second pump-out module 250, a hydraulic module 255 and a probe module/formation tester (referred to as a probe module) 260. The wireline tool 205 may include any number of modules and may incorporate different types of modules for performing different functions than those described above. The field joints 230 are provided between each adjacent pair of modules for reliably connecting the fluid and/or electrical lines extending through the wireline tool 205.

Figure 3:
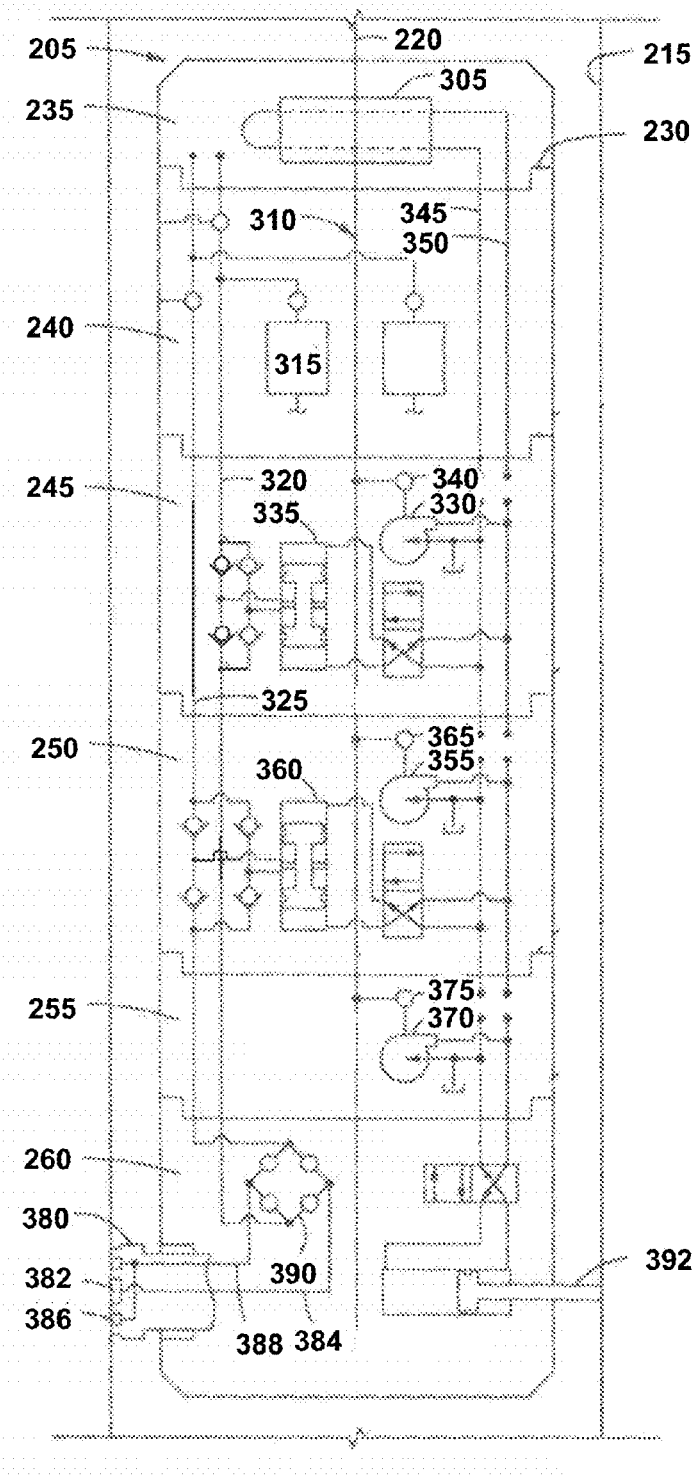

Referring to FIG. 3, illustrated is a schematic view of portions of the wireline tool 205 of FIG. 2 including the electronics module 235, the sample chamber module 240, the first pump-out module 245, the second pump-out module 250, the hydraulic module 255 and the probe module 260 suspendable in the wellbore 215. The electronics module 235 includes an electronics controller 305 operatively coupled to the wireline 220. An electrical line 310 is coupled to an interface of the controller 305 and includes segments that extend through each of the modules. The electrical line 310 transmits electronic signals, which may include the transmission of electrical power and/or data. The sample chamber module 240 includes sample chambers (one of which is designated 315) configured to store fluid samples.

The first and second pump-out modules 245, 250 are configured to control flow through first and second fluid lines 320, 325, respectively. The first pump-out module 245 includes a pump 330 and a displacement unit 335. A motor 340 is operatively coupled to the pump 330. The pump 330 and displacement unit 335 are fluidly coupled to a hydraulic fluid line 345 and a hydraulic fluid return line 350. The displacement unit 335 is also fluidly coupled to the first and second fluid lines 320, 325. The second pump-out module 250 similarly includes a pump 355 and a displacement unit 360, with a motor 365 operatively coupled to the pump 355. The pump 355 and displacement unit 360 are fluidly coupled to the hydraulic fluid line 345 and the hydraulic fluid return line 350. The displacement unit 360 is also fluidly coupled to the first and second fluid lines 320, 325.

The hydraulic module 255 controls the flow of hydraulic fluid through hydraulic fluid lines. The hydraulic module 255 includes a pump 370 fluidly coupled to the hydraulic fluid line 345 and the hydraulic fluid return line 350. A motor 375 is operatively coupled to the pump 370.

The probe module 260 is configured to obtain fluid samples from the subterranean formation. The probe module 260 includes a probe assembly 380 having a sample inlet 382 fluidly coupled to a sample line 384 and a guard inlet 386 fluidly coupled to a guard line 388. The sample line 384 and guard line 388 are fluidly coupled to a bypass valve system 390, which in turn is fluidly coupled to the first and second fluid lines 320, 325. The probe module 260 also includes a setting piston 392, which is operably coupled to the hydraulic fluid line 345 and the hydraulic fluid return line 350. The bypass valve system 390 is shown as part of the probe module 260, but the bypass valve system 390 may be implemented as a module that can be placed anywhere in the wireline tool 205 or elsewhere and/or duplicated. The bypass valve system 390 contributes, together with the field joint 230, to an adaptability of the wireline tool 205.

Although not shown in FIG. 3, the wireline tool 205 may also include one or more sensors (or measurement devices), or a sensor (or a measurement) module having one or more sensors (or measurement devices), configured to measure or detect a fluid property. The fluid properties such as pressure, flow rate, resistivity, optical transmission or reflection, fluorescence, nuclear magnetic resonance, density, and viscosity are amongst the most used.

As illustrated in FIG. 3, each module includes fluid and electrical lines that are connected when the wireline tool 205 is assembled. The illustrated embodiment includes four separate fluid lines, namely, the first and second fluid lines 320, 325, the hydraulic fluid line 345 and the hydraulic fluid return line 350. Additionally, the electrical line 310 extends through each module. While the electrical line 310 is illustrated in FIG. 3 with a single line, the wireline tool 205 may include multiple separate electrical wires or lines, each of which may have a separate function and may carry different voltages or amperages. Additionally, or alternatively, multiple redundant electrical lines may be provided to perform the same function. When multiple electrical lines are provided, there are multiple electrical connections that are made between the modules. Consequently, the connection interfaces or field joints 230 are configured to reliably connect the segments of various fluid flow and electrical lines. Additionally, it is important to isolate the electrical connections from one another and from the fluid lines to prevent inadvertent shorts, and to reduce or prevent fluid from contaminating the electrical connections. An exemplary wireline tool is introduced in U.S. Patent Application Publication No. 2009/0025926, by Briquet, et al., entitled "Field Joint for a Downhole Tool," published Jan. 29, 2009, which is incorporated herein by reference in its entirety.

Figure 4:
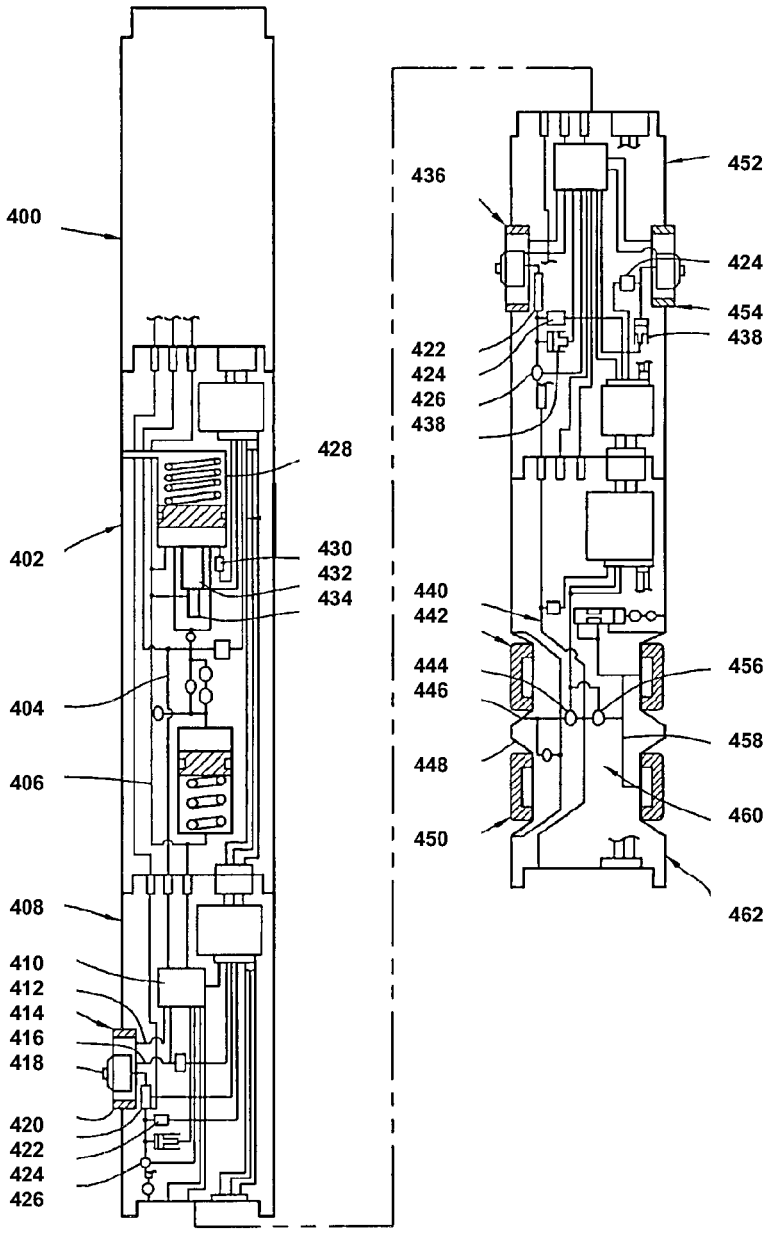
Figure 5:
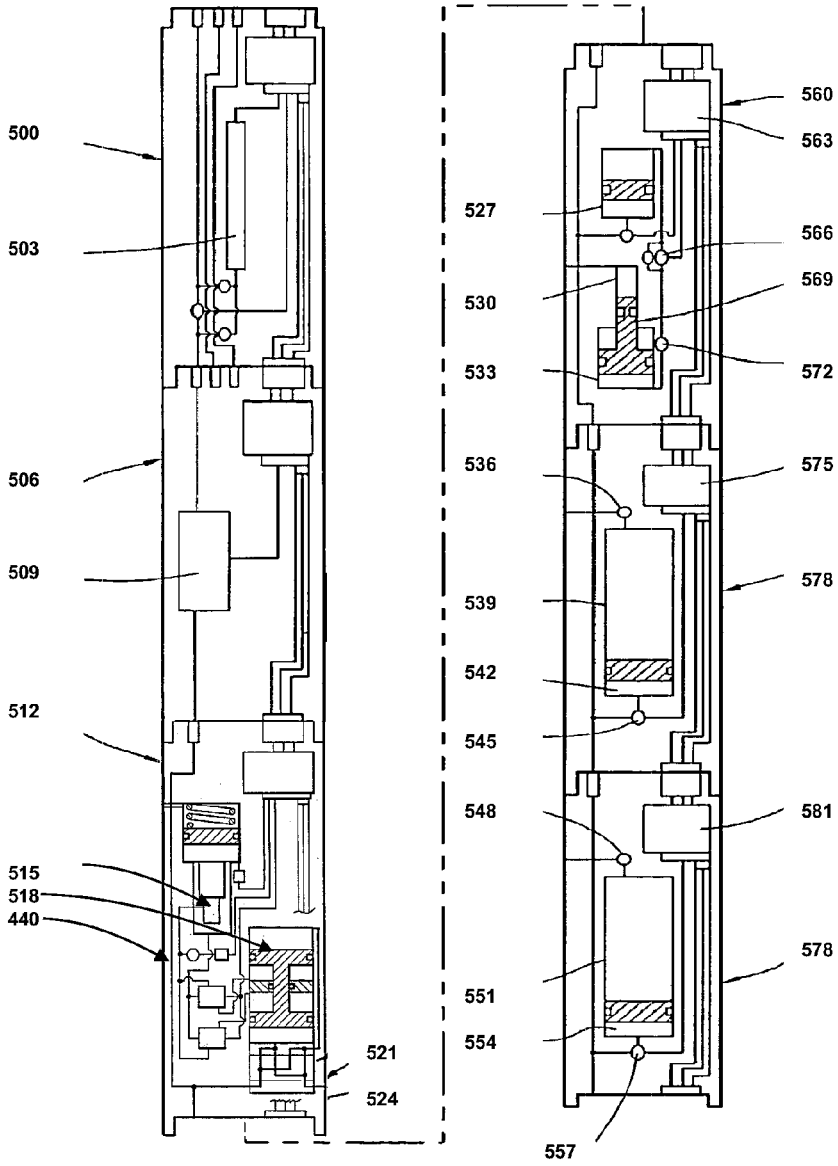

Referring to FIGS. 4 and 5, illustrated are schematic views of apparatus according to one or more aspects of the present disclosure. The apparatus is a downhole tool that can be lowered into a wellbore (not shown) by a wireline (not shown) for the purpose of conducting formation property tests. The wireline connections to the downhole tool as well as power supply and communications-related electronics are not illustrated herein.

The downhole tool includes a hydraulic module 402, a packer module 462 and a probe module/formation tester (referred to as a probe module) 408. The probe module 408 is shown with a probe assembly 414 that may be used for formation pressure tests, permeability tests or fluid sampling. When using the downhole tool to determine anisotropic permeability and a vertical reservoir structure according to known techniques, a multiprobe module/formation tester (referred to as a multiprobe module) 452 can be added to the downhole tool. The multiprobe module 452 includes a horizontal probe assembly 454 and a sink probe assembly 436.

The hydraulic module 402 includes a pump 434, a reservoir 428 and a motor 432 to control the operation of the pump 434. A low oil switch 430 also forms part of a control system and is used in regulating the operation of the pump 434. It should be noted that the operation of the pump 434 can be controlled by pneumatic or hydraulic means.

A hydraulic fluid line 404 is connected to the discharge of the pump 434 and runs through the hydraulic module 402 and into adjacent modules for use as a hydraulic power source. The hydraulic fluid line 404 may extend through the hydraulic module 402 into the packer module 462 via the probe module 408 and/or the multiprobe module 452 depending upon which configuration is used. A hydraulic loop is closed by virtue of a hydraulic fluid return line 406 that may extend from the probe module 408 back to the hydraulic module 402 and terminates at the reservoir 428.

A pump-out module 512 (see FIG. 5) can be used to dispose of unwanted samples by virtue of pumping fluid through a fluid line 440 into the wellbore, or may be used to pump fluids from the wellbore into the fluid line 440 to inflate straddle packers 442, 450. Furthermore, the pump-out module 512 may be used to draw formation fluid from the wellbore via the probe module 408 or the multiprobe module 452, and then pump the formation fluid into a sample chamber module 578 against a buffer fluid therein.

A bi-directional piston pump 518, energized by hydraulic fluid from a pump 515, can be aligned to draw from the fluid line 440 and dispose of the unwanted sample though a fluid line 524 or may be aligned to pump fluid from the wellbore (via the fluid line 524) to the fluid line 440. The pump-out module 512 has the necessary control devices to regulate the bidirectional piston pump 518 and align the fluid line 440 with the fluid line 524 to accomplish the pump-out procedure. It should be noted here that the bi-directional piston pump 518 can be used to pump samples into sample chamber module(s) 578, including overpressuring such samples as desired, as well as to pump samples out of sample chamber module(s) 578 using the pump-out module 512. The pump-out module 512 may also be used to accomplish constant pressure or constant rate injection if necessary. With sufficient power, the pump-out module 512 may be used to inject fluid at high enough rates so as to enable creation of microfractures for stress measurement of the formation.

Alternatively, the straddle packers 442, 450 (see FIG. 4) can be inflated and deflated with hydraulic fluid from the pump 434. As can be readily seen, selective actuation of the pump-out module 512 to activate the bi-directional piston pump 518 combined with selective operation of a control valve assembly 521 and inflation/deflation valves 460, can result in selective inflation or deflation of the straddle packers 442, 450. The straddle packers 442, 450 are mounted to an outer periphery 448 of the downhole tool, and are preferably constructed of a resilient material compatible with wellbore fluids and temperatures. The straddle packers 442, 450 have a cavity therein. When the bi-directional piston pump 518 is operational and the inflation/deflation valves 460 are properly set, fluid from the fluid line 440 passes through the inflation/deflation valves 460, and through a fluid line 458 to the straddle packers 442, 450.

As illustrated in FIG. 4, the probe module 408 includes the probe assembly 414 that is selectively movable with respect to the downhole tool. The movement of the probe assembly 414 is initiated by operation of a probe actuator 410 that aligns the hydraulic fluid lines 404, 406 with the fluid lines 412, 416. A probe 418 is mounted to a frame 420 that is movable with respect to the downhole tool, and the probe 418 is movable with respect to the frame 420. These relative movements are initiated by the probe actuator 410 by directing fluid from the hydraulic fluid lines 404, 406 selectively into the fluid lines 412, 416 with the result being that the frame 420 is initially outwardly displaced into contact with the wellbore wall (not shown). The extension of the frame 420 helps to steady the downhole tool during use and brings the probe 418 adjacent the wellbore wall. Since one objective is to obtain an accurate reading of pressure in the formation, which pressure is reflected at the probe 418, it is desirable to further insert the probe 418 through a built up mudcake and into contact with the formation. Thus, alignment of the hydraulic fluid line 404 with the fluid line 416 results in a relative displacement of the probe 418 into the formation by relative motion of the probe 418 with respect to the frame 420. The operation of the sink and horizontal probe assemblies 436, 454 is similar to that of the probe assembly 414.

Having inflated straddle packers 442, 450 and set the probe 418 and/or the sink and horizontal probe assemblies 436, 454, the fluid withdrawal testing of the formation can begin. The fluid line 440 extends from the probe 418 in the probe module 408 down to the outer periphery 448 at a point between the straddle packers 442, 450 through adjacent modules and into the sample chamber modules 578. The probe 418 and/or the sink and horizontal probe assemblies 436, 454 allow entry of the formation fluids into the fluid line 440 via one or more of a resistivity measurement device 422, a pressure measurement device 424, and a pretest mechanism 438, according to the desired configuration. When using the probe module 408 and/or the multiprobe module 452, an isolation valve 426 is mounted downstream of the resistivity measurement device 422. In the closed position, the isolation valve 426 limits the internal fluid line volume, improving the accuracy of dynamic measurements made by the pressure measurement device 424. After initial pressure tests are made, the isolation valve 426 can be opened to allow flow into other modules.

When taking initial samples, there is a high prospect that the formation fluid initially obtained is contaminated with mudcake and filtrate. It is desirable to purge such contaminants from the sample flow stream prior to collecting the sample(s). Accordingly, the pump-out module 512 is used to initially purge from the downhole tool specimens of formation fluid taken through an inlet 446 of the straddle packers 442, 450, or the probe 418, or the sink and horizontal probe assemblies 436, 454 into the fluid line 440.

A fluid analysis module 506 includes an optical fluid analyzer 509 that is particularly suited for the purpose of indicating where the fluid in the fluid line 440 is acceptable for collecting a high quality sample. The optical fluid analyzer 509 is equipped to discriminate between various oils, gas and water (see, e.g., U.S. Pat. No. 4,994,671, issued to Safinya, et al., entitled "Apparatus and Method for Analyzing the Composition of Formation Fluids," issued Feb. 19, 1991, U.S. Pat. No. 5,166,747, issued to Schroeder, et al., entitled "Apparatus and Method for Analyzing the Composition of Formation Fluids," issued Nov. 24, 1992, U.S. Pat. No. 5,939,717, issued to Mullins, entitled "Methods and Apparatus for Determining Gas-Oil Ratio in a Geological Formation Through the Use of Spectroscopy," issued Aug. 17, 1999 and U.S. Pat. No. 5,956,132, issued to Donzier, entitled "Method and Apparatus for Optically Discriminating Between the Phases of a Three-Phase Fluid," issued Sep. 21, 1999, which are incorporated herein by reference in their entirety).

While flushing out the contaminants from the downhole tool, formation fluid can continue to flow through the fluid line 440 that extends through adjacent modules such as a precision pressure module 500, the fluid analysis module 506, the pump-out module 512, a flow control module 560, and any number of the sample chamber modules 578 that may be attached. Those skilled in the art will appreciate that by having a fluid line 440 running the length of various modules, multiple sample chamber modules 578 can be stacked without necessarily increasing the overall diameter of the downhole tool.

The flow control module 560 includes a flow sensor (or measurement device) 572, a flow controller 563 and a selectively adjustable restriction device such as a valve 566. A predetermined sample size can be obtained at a specific flow rate by use of the equipment in conjunction with reservoirs 527, 530, 533. The reservoir 533 is pressure balanced with approximately one-third wellbore pressure, by way of a piston 569 and the reduced diameter of the reservoir 530 relative to the reservoir 533. This is one example wherein wellbore fluid is used as a buffer fluid to control the pressure of the fluid in the fluid line 440 and the pressure of a sample being taken.

The sample chamber module 578 can then be employed to collect a sample of the fluid delivered via the fluid line 440 where the piston motion is controlled via the buffer fluid from the non-sample side of the piston being regulated by the flow control module 560, which is beneficial but not necessary for fluid sampling. With reference first to an upper sample chamber module 578 in FIG. 5, a shut-off valve 545 is opened, and the isolation valve 426 and isolation valves 444, 456 are held closed, thus directing the formation fluid in the fluid line 440 into a sample collecting cavity 542 in a sample chamber 539 of the upper sample chamber module 578, after which the shut-off valve 545 is closed to isolate the sample. The downhole tool can then be moved to a different location and the process repeated. Additional samples taken can be stored in any number of additional sample chamber modules 578 that may be attached by suitable alignment of valves. For example, there are two sample chambers modules 578 illustrated in FIG. 5.

After having filled the upper sample chamber module 578 by operation of the shut-off valve 545, the next sample can be stored in a lower sample chamber module 578 by opening a shut-off valve 557 connected to sample collecting cavity 554 of a sample chamber 551. It should be noted that each sample chamber module 578 has its own control assembly 575, 581. Any number of sample chamber modules 578, or no sample chamber modules, can be used in particular configurations of the downhole tool depending upon the nature of the test to be conducted. Also, the sample chamber module 578 may be a multi-sample chamber module that houses a plurality of sample chambers.

It should also be noted that the buffer fluid in the form of full-pressure wellbore fluid may be applied to the backsides of the pistons in the sample chambers 539, 551 to further control the pressure of the formation fluid being delivered to the sample chamber modules 578. For this purpose, valves 536, 548 are opened, and the bi-directional piston pump 518 of the pump-out module 512 pumps the fluid in the fluid line 440 to a pressure exceeding wellbore pressure. It has been discovered that this action has the effect of dampening or reducing the pressure pulse or "shock" experienced during drawdown. This low shock sampling method has been used to particular advantage in obtaining fluid samples from unconsolidated formations. In conjunction with an electric power module 400, it should also be known that various configurations of the downhole tool can be employed depending upon the objective (e.g., basic sampling, reservoir pressure determination, uncontaminated sampling at reservoir conditions, simulated drill stem testing) to be accomplished. The downhole tool can be of unitary construction as well as modular, however, the modular construction allows greater flexibility and lower cost, to users not requiring all attributes.

As mentioned above, the fluid line 440 also extends through the precision pressure module 500. A precision gauge 503 of the precision pressure module 500 should preferably be mounted as close to the sink and horizontal probe assemblies 436, 454, 436 (or the probe 418) as possible to reduce internal fluid line length that, due to fluid compressibility, may affect pressure measurement responsiveness. The precision gauge 503 is more sensitive than the pressure measurement device 424 for more accurate pressure measurements with respect to time. The precision gauge 503 is preferably a quartz pressure gauge that performs the pressure measurement through the temperature and pressure dependent frequency characteristics of a quartz crystal, which is known to be more accurate than the comparatively simple strain measurement that a strain gauge employs. Suitable valving of the control mechanisms can also be employed to stagger the operation of the pressure measurement device 424 and the precision gauge 503 to take advantage of their difference in sensitivities and abilities to tolerate pressure differentials.

The individual modules of downhole tool are constructed so that they quickly connect to each other. Preferably, flush connections between the modules may be used in lieu of male/female connections to avoid points where contaminants, common in a wellsite environment, may be trapped. Flow control during sample collection allows different flow rates to be used. Flow control is useful in getting meaningful formation fluid samples as quickly as possible that reduces the chance of binding the wireline and/or the downhole tool because of mud oozing into the formation in high permeability situations. In low permeability situations, flow control is very helpful to prevent drawing formation fluid sample pressure below its bubble point or asphaltene precipitation point.

More particularly, the "low shock sampling" method is useful for reducing the pressure drop in the formation fluid during drawdown so as to reduce the "shock" on the formation. By sampling at a lower pressure drop, the likelihood of keeping the formation fluid pressure above asphaltene precipitation point pressure as well as above bubble point pressure is also increased. In one method of achieving the objective of a reduced pressure drop, the sample chamber is maintained at wellbore hydrostatic pressure as described above, and the rate of drawing connate fluid into the downhole tool is controlled by monitoring the tool's inlet fluid line pressure via the pressure measurement device 424 and adjusting the formation fluid flow rate via the bi-directional piston pump 518 and/or the flow control module 560 to induce a reduced drop in the monitored pressure that produces fluid flow from the formation. In this manner, the pressure drop is reduced through regulation of the formation fluid flow rate. For a better understanding of the modules of the downhole tool, see U.S. Pat. No. 7,243,536, issued to Bolze, et al., entitled "Formation Fluid Sampling Apparatus and Method," issued Jul. 17, 2007, which is incorporated herein by reference in its entirety.

Figure 6:
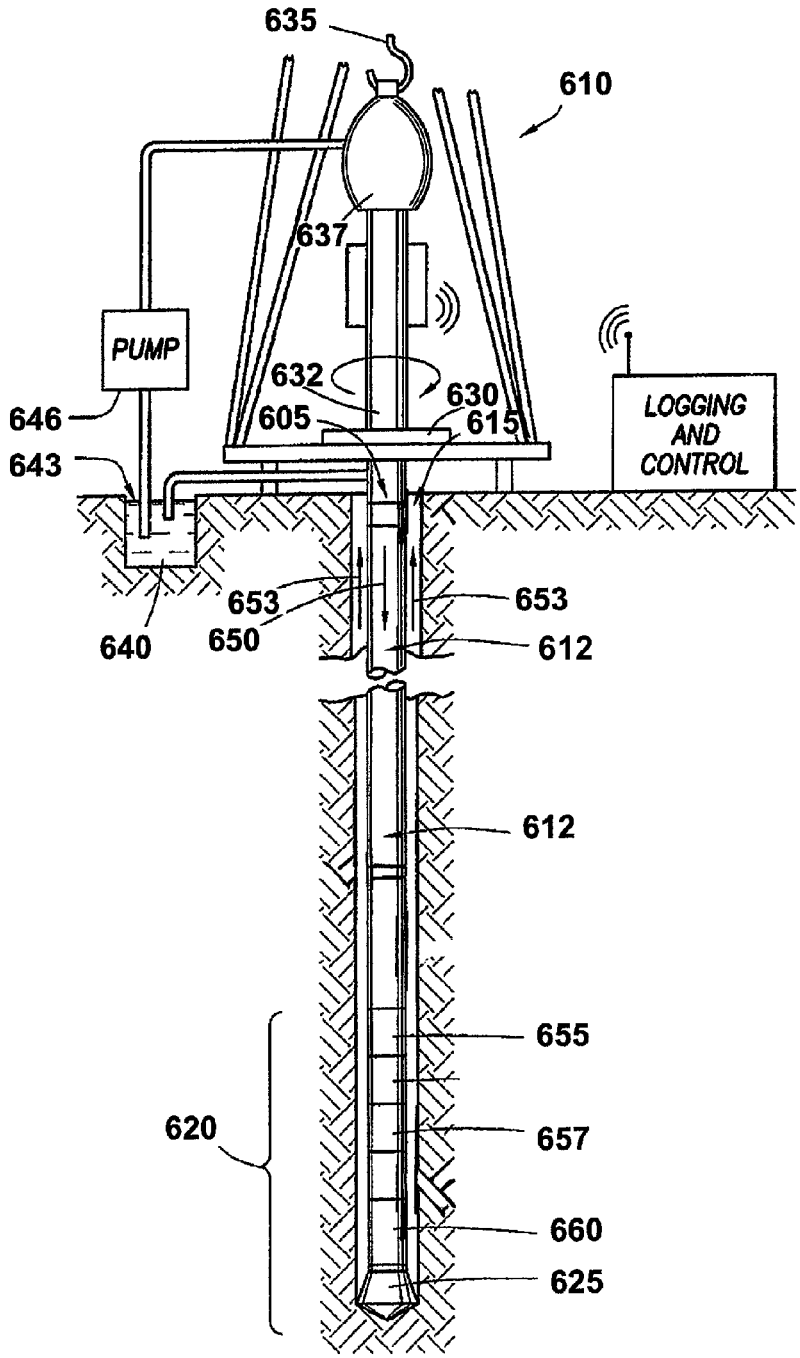

Referring to FIG. 6, illustrated is a schematic view of apparatus according to one or more aspects of the present disclosure. The apparatus includes a drill string 605 deployed from a platform (also known as a platform and derrick assembly) 610 that provides an environment for application of one or more aspects of the present disclosure. The platform 610 and drill string 605 may be a part of an onshore or offshore well site. In this exemplary well site, a wellbore 615 is formed in subterranean formations by rotary drilling in a manner that is well known, which may also include directional drilling.

The drill string 605 is suspended within the wellbore 615, and includes a plurality of drill pipes (one of which is designated 612) and a bottom hole assembly 620 with a drill bit 625 at its lower end. The platform 610 is positioned over the wellbore 615 and includes a rotary table 630, a kelly 632, a hook 635 and a rotary swivel 637. The drill string 605 is rotated by the rotary table 630, energized by means not shown, which engages the kelly 632 at the upper end of the drill string 605. The drill string 605 is suspended from the hook 635, attached to a traveling block (also not shown) through the kelly 632 and the rotary swivel 637, which permits rotation of the drill string 605 relative to the hook 635. As is well known, a topdrive may alternatively be used.

At the surface of the well site, drilling fluid (or mud) 640 is stored in a pit (or tank) 643. A pump 646 delivers the drilling fluid 640 to the interior of the drill string 605 via a port in the rotary swivel 637, causing the drilling fluid 640 to flow downwardly through the drill string 605 as indicated by the directional arrow 650. The drilling fluid 640 exits the drill string 605 via ports in the drill bit 625 and then circulates upwardly through the annulus region between the outside of the drill string 605 and the wall of the wellbore 615, as indicated by the directional arrows 653. In this well-known manner, the drilling fluid 640 lubricates the drill bit 625 and carries formation cuttings up to the surface as it is returned to the pit 643 for recirculation.

The bottom hole assembly 620 is constructed with an LWD module (one of which is designated 655), a measurement while drilling ("MWD") module (one of which is designated 657), a roto-steerable system and motor 660 and the drill bit 625. The LWD module 655 is housed in a special type of drill collar, as is known in the art, and can contain one or a plurality of known types of logging tools. It will also be understood that more than one LWD module 655 and/or MWD module 657 can be employed. The LWD module 655 may include capabilities for measuring, processing and storing information, as well as for communicating with the surface equipment. In the present embodiment, the LWD module 655 includes, without limitation, a fluid-sampling device or a pressure measurement device.

The MWD module 657 is also housed in a special type of drill collar, as is known in the art, and can contain one or more devices for measuring characteristics of the drill string 605 and drill bit 625. The well site further includes power equipment (not shown) for generating electrical power to the drill string 605. While this may typically include a mud turbine generator powered by the flow of the drilling fluid, it should be understood that other power and/or battery systems may be employed. In the present embodiment, the MWD module 657 includes, without limitation, one or more measuring devices such as a weight-on-bit measuring device, a torque measuring device, a vibration measuring device, a shock measuring device, a stick slip measuring device, a direction measuring device and an inclination measuring device.

Figure 7:
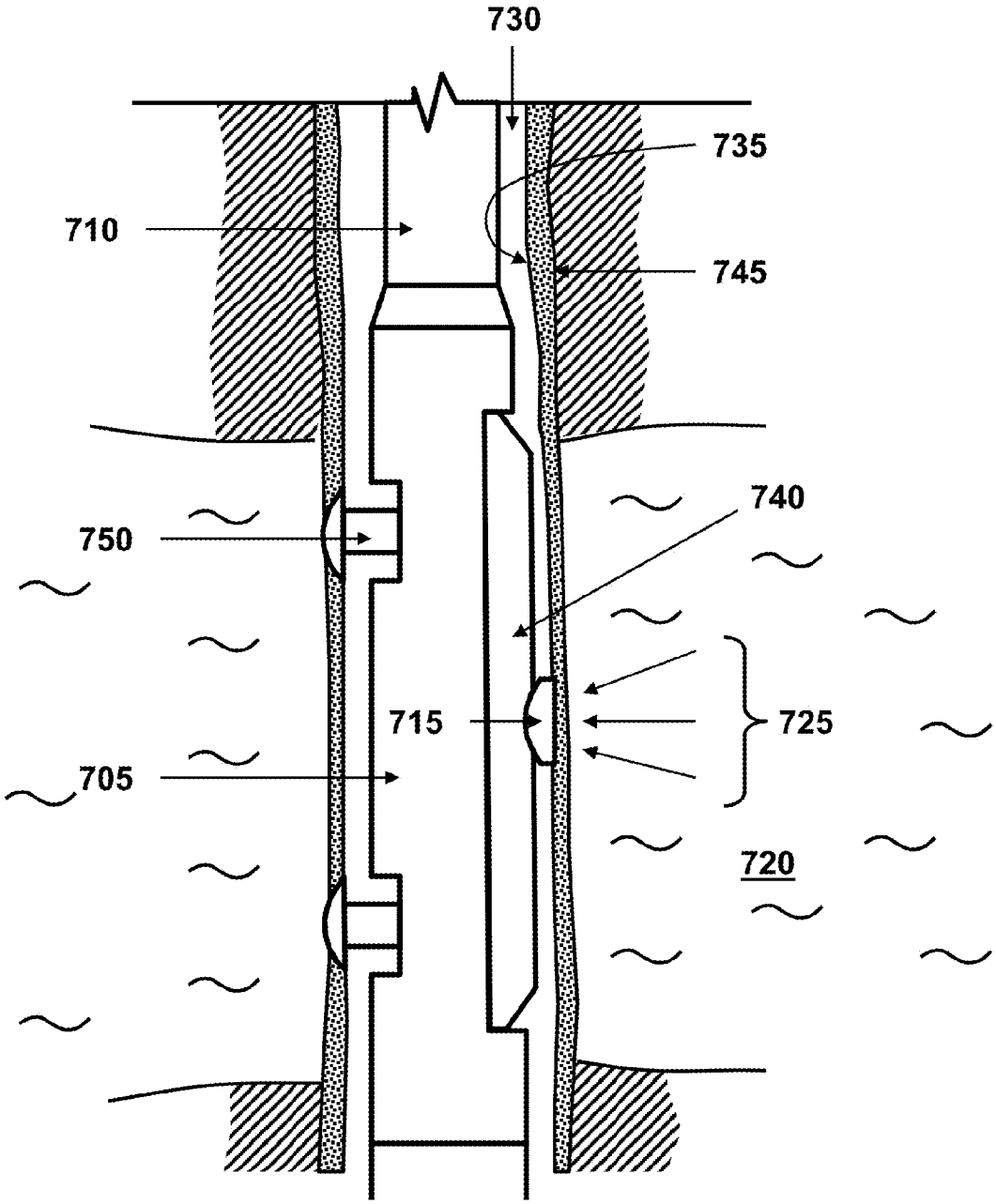

Referring to FIG. 7, illustrated is a schematic view of apparatus according to one or more aspects of the present disclosure. The apparatus includes an LWD module 705 coupled to a drill collar 710 that provides an environment for application of one or more aspects of the present disclosure. As an example, an LWD module is described in U.S. Pat. No. 7,114,562, issued to Fisseler, et al., entitled "Apparatus and Method for Acquiring Information While Drilling," issued Oct. 3, 2006, which is incorporated herein by reference in its entirety. The LWD module 705 is provided with a probe 715 for establishing fluid communication with the surrounding subterranean formation and drawing a fluid 720 into the LWD module 705, as indicated by the arrows 725.

As illustrated in FIG. 7, the wellbore 730 is lined with a lining 735, such as a mudcake. The probe 715 may be positioned in a stabilizer blade 740 of the LWD module 705 and extended therefrom to engage a wall 745 of the wellbore 730. The stabilizer blade 740 may include one or more blades that are in contact with the wall 745 of the wellbore 730. The fluid 720 drawn into the LWD module 705 using the probe 715 may be measured to determine, for example, reservoir parameters. Additionally, the LWD module 705 may be provided with devices, such as sample chambers, for collecting samples of fluid 720 for retrieval at the surface. Backup pistons (one of which is designated 750) may also be provided to assist in applying force to push the LWD module 705 and/or probe 715 against the wall 745 of the wellbore 730.

Figure 8:
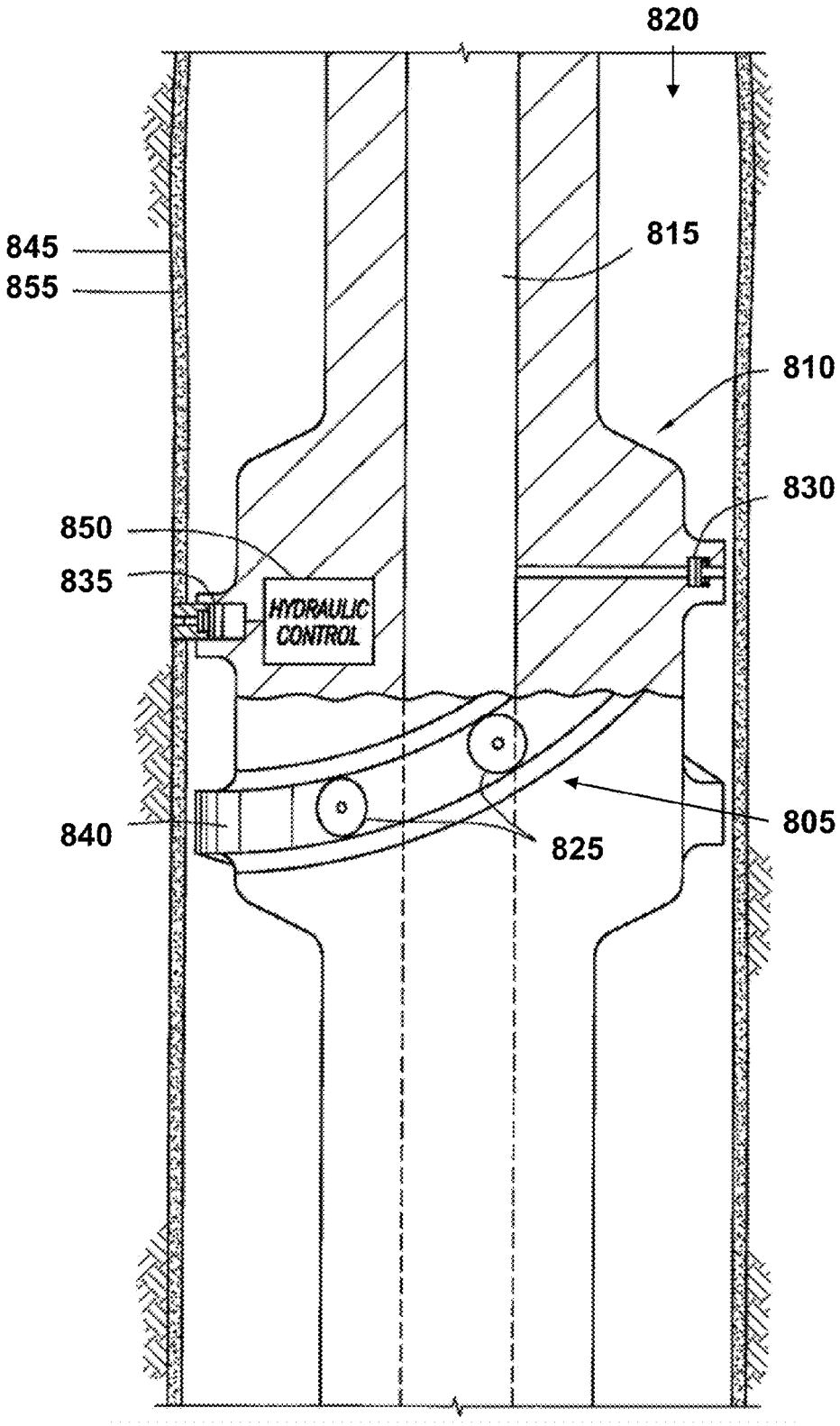

Referring to FIG. 8, illustrated is a schematic view of apparatus according to one or more aspects of the present disclosure. The apparatus includes a logging device 805 employable in an LWD module that provides an environment for application of one or more aspects of the present disclosure. As an example, a logging device is described in U.S. Pat. No. 6,986,282, issued to Ciglenec, et al., entitled "Method and Apparatus for Determining Downhole Pressures during a Drilling Operation," issued Jan. 17, 2006, which is incorporated herein by reference in its entirety. The logging device 805 can be employed for determining downhole pressures during a drilling operation including annular pressure, formation pressure and pore pressure. It is understood that other types of pressure measuring or sampling devices can also be utilized in accordance with an LWD module, or part of an LWD suite of modules.

The exemplary logging device 805 is formed in a modified stabilizer collar 810 that has a passage 815 for drilling fluid extending therethrough. The flow of fluid through the logging device 805 creates an internal pressure PI. The exterior of the logging device 805 is exposed to the annular pressure PA of the surrounding wellbore 820. The differential pressure $\delta P$ between the internal pressure PI and the annular pressure PA may be used to activate first pressure measurement devices 825. Second and third pressure measurement devices 830, 835 are mounted on stabilizer blades such as stabilizer blade 840. The second pressure measurement device 830 is used to monitor annular pressure in the wellbore 820 and/or pressures of the surrounding subterranean formation, when positioned in engagement with a wall 845 of the wellbore 820.

In the illustrated embodiment, the second pressure measurement device 830 does not engage the wall 845 of the wellbore 820 and, therefore, may measure annular pressure, if desired. When moved into engagement with the wall 845 of the wellbore 820, the second pressure measurement device 830 may be used to measure pore pressure of the surrounding subterranean formation. The third pressure measurement device 835 is extendable from a stabilizer blade using hydraulic control 850 for sealing engagement with a mudcake 855 and/or the wall 845 of the wellbore 820 for taking measurements of the surrounding subterranean formation. Circuitry (not shown) couples signals representing a sensed pressure to a controller, an output of which may be coupled to a communication channel to the surface of the wellbore 820.

As described herein, deviations from anticipated environmental conditions can often cause a valve assembly (or valve) to malfunction. Operation of downhole valves is dependent on local environmental conditions or parameters such as the hydrostatic pressure within the annulus of the wellbore, or pressure in the surrounding subterranean formation. These conditions or parameters make the response of a downhole valve to primitive commands specifically dependent on an anticipated, but sometimes, unpredictable environment. As introduced herein, the tasks, processing, telemetry and power for a downhole valve may be detached from surface controllers or computer systems by constructing the valve assembly to work independently. The valve assemblies are able to accomplish the tasks in accordance with localized logical control of such actions.

The valve assemblies are constructed to switch logically between on and off positions in accordance with a characteristic (e.g., an internal characteristic such as the orientation or position of a mechanism coupled to an actuator) of the valve assembly and a parameter of an environment (e.g., a temperature or pressure) associated with, but external to, the valve assembly. The valve assembly operates from a local controller such as (or including) a processor or other logical device installed within the valve assembly and is powered from a local power source such as a battery. The local power source can be selectively employed by the valve assembly when the valve assembly needs to function and an external power source is not available. Alternatively, the local power source can be continuously employed to enable the valve assembly to perform its own control functions and supply power as needed for an actuator or other valve mechanism.

The valve assembly includes a controller such as (or including) a processor or other logical device that performs valve assembly control tasks and acquires signals from sensors (or measurement devices) and valve actuators. The valve assembly also includes an actuator that controls the mechanism for valve assembly movements to perform the desired operation. The actuator can be a solenoid, motor, or any other type of mechanical drive device. The valve assembly also includes a sensing apparatus with sensors that provide feedback signals to the controller. The feedback signals include an environmental parameter (e.g., pressure, temperature, or flow rate) and a characteristic of the valve assembly such as the positioning or movement of a mechanism coupled to an actuator. The sensors enable the controller to sense progress of a task to be performed, and can be part of a feedback loop to the controller to monitor, execute, or otherwise control other valve operations. The valve assembly also includes a valve mechanism or other mechanism that is attached to an actuator to perform a task. The valve mechanism can interact with the sensors (or measurement devices). Valve control, sensing and actuators can be integrated or otherwise contained within the valve assembly itself. The valve performs its tasks based on computer program code loaded on the controller, and may operate independently of an external power source.

Figure 9:
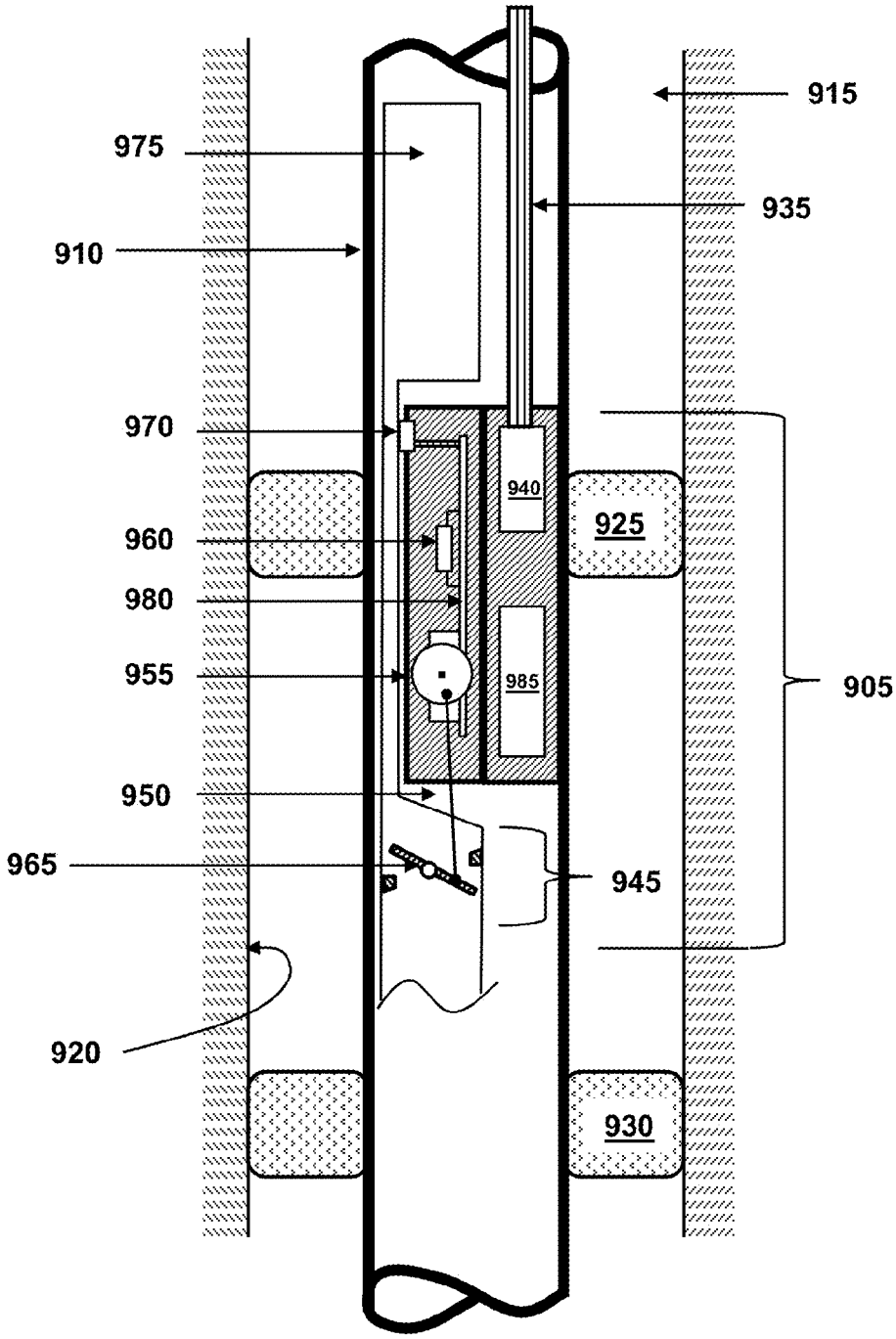

Referring to FIG. 9, illustrated is a schematic view of apparatus according to one or more aspects of the present disclosure. The apparatus includes a valve assembly 905 constructed according to one or more aspects of the present disclosure. The valve assembly 905 is located in a downhole tool 910 that may be positioned in a wellbore 915 by a wireline or wired drill pipe string, such as via the apparatus shown in any of the preceding FIGUREs. The annulus between the downhole tool 910 and a wall 920 of the wellbore 915 is sealed by an upper inflatable packer 925 and a lower inflatable packer 930. The valve assembly 905 may communicate with and be powered by a surface system over communication channel (e.g., a communication and powering path) 935 via a communication module 940. The communication channel 935 may be formed as a cable positioned within the wellbore 915, within a drill pipe from which the downhole tool 910 is suspended in the wellbore 915, or within the annulus between the downhole tool 910 and the wall 920 of the wellbore 915, and/or may be at least partially positioned or formed into a wall of a drill pipe from which the downhole tool 910 is suspended in the wellbore 915.

The valve assembly 905 is formed with a valve mechanism 945 that may be positioned to block flow of fluid within a flow passage within the downhole tool 910 (shown only schematically in FIG. 9). A valve actuator mechanism/linkage 950 mechanically couples the valve mechanism 945 to a valve actuator (or actuator) 955. The valve actuator 955 is controlled by a controller 960 that responds to a sensing apparatus including a valve mechanism sensor 965 to sense a rotational position of the valve mechanism 945. In an alternative embodiment, the valve mechanism sensor 965 may be directly coupled to the valve actuator 955. In yet another alternative embodiment, the valve mechanism sensor 965 is configured to sense whether the valve mechanism 945 has reached an end of actuation (e.g., from an open to closed position, or vice versa). For example, the valve mechanism sensor 965 may include a contact switch. The controller 960 is also coupled to the sensing apparatus including an environmental sensor 970 that senses a parameter of an environment associated with, but external to, the valve assembly 905 such as a pressure or temperature in a flow passage within the downhole tool 910, pressure or temperature in the annulus between the downhole tool 910 and the wall 920 of the wellbore 915, or combinations thereof. The controller 960, the valve actuator 955 and the environmental sensor 970 may be mounted on a printed wiring board 980. A battery 985 may be integrated into the physical structure of the valve assembly 905 to provide local power for the valve actuator 955, controller 960 and other elements of the valve assembly 905, if necessary.

The downhole tool 910 also includes a sample chamber 975 that responds to a signal from the controller 960 to sample a fluid (or other characteristic) in the annulus between the downhole tool 910 and the wall 920 of the wellbore 915. The sample chamber 975 is configured to sample a fluid (or other characteristic) in the surrounding subterranean formation. The valve assembly 905 is fluidly coupled to the sample chamber 975. The controller 960 may be configured to actuate the valve mechanism 945 based on a signal provided by the environmental sensor 970 and a signal provided by the valve mechanism sensor 965. For example, the controller 960 may provide a signal to the actuator 955, such as a command to close the valve mechanism 945. The valve mechanism 945 may be closed when the signal provided by the environmental sensor 970 is indicative that a measured pressure is larger than a pressure threshold, and the signal provided by the valve mechanism sensor 965 is indicative that the valve mechanism 945 is open. The controller 960 may also be configured to communicate the status of the valve mechanism 945 via the communication module 940, such as a signal indicative of whether the valve mechanism 945 is close.

While the scope of the application for the valve assembly is not limited, the valve assembly may be employed in selected ones of the valves illustrated and described with respect to FIGS. 4 and 5 above. For example, the valve assembly 905 may alternatively by fluidly coupled to one or both of the upper inflatable packer 925 and the lower inflatable packer 930, and may be configured to operate based on a signal indicative of an inflation pressure and a signal indicative of a position of the valve mechanism 945.

Figure 10:
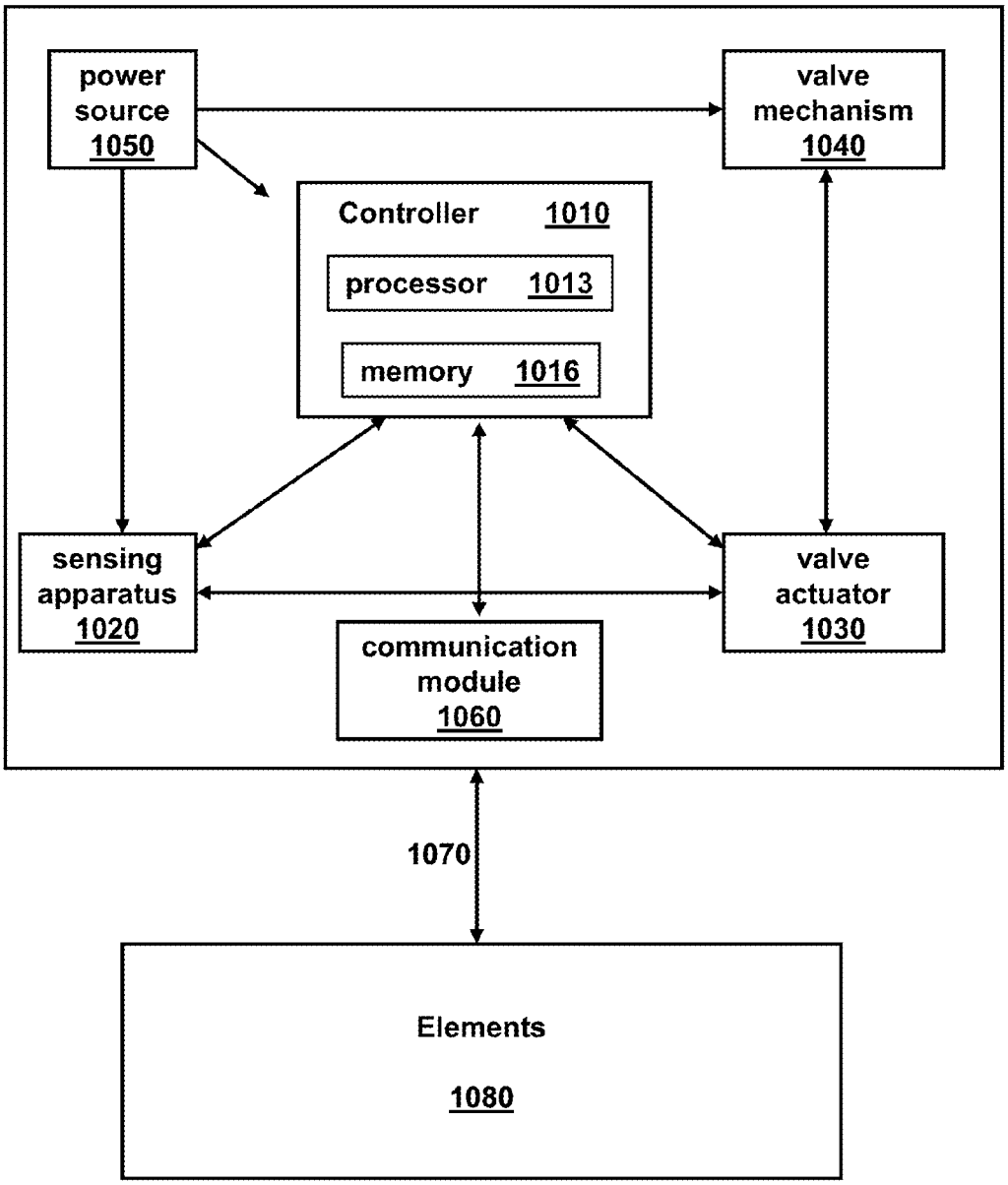

Referring to FIG. 10, illustrated is a schematic view of apparatus according to one or more aspects of the present disclosure. The apparatus includes a valve assembly constructed according to one or more aspects of the present disclosure. The valve assembly includes a controller 1010 that is coupled to a sensing apparatus 1020 and a valve actuator (or actuator) 1030. The valve actuator 1030 is coupled to a valve mechanism 1040 such as a valve spool or a valve butterfly to control fluid flow through the valve assembly. The sensing apparatus 1020 includes a first sensor configured to provide a first signal based on a parameter of an environment associated with, but external to, the valve assembly and a second sensor configured to provide a second signal based on a characteristic of the valve assembly such as a position of the valve mechanism 1040. The valve assembly further includes a local power source 1050 such as a battery.

The valve assembly includes a communication module 1060 configured to enable communication via a communication and powering path 1070 with other elements 1080 such as valves, sensors, mechanisms, processors or telemetry components to a surface system (or surface computer system). The communication and powering path 1070 also enables elements of the valve assembly to be powered from an energy source on the surface of the earth.

Selected modules of the valve assembly such as the controller 1010 and the communication module 1060 may be implemented with one or a plurality of processors (see, e.g., processor 1013 of the controller 1010) of any type suitable to the local application environment, and may include one or more of general-purpose computers, special purpose computers, microprocessors, digital signal processors ("DSPs"), field-programmable gate arrays ("FPGAs"), application-specific integrated circuits ("ASICs"), and processors based on a multi-core processor architecture, as non-limiting examples. Selected modules of the valve assembly such as the controller 1010 and communication module 1060 may also include one or more memories (see, e.g., memory 1016 of the controller 1010) of any type suitable to the local application environment, and may be implemented using any suitable volatile or nonvolatile data storage technology such as a semiconductor-based memory device, a magnetic memory device and system, an optical memory device and system, fixed memory, and removable memory. The programs stored in the memory may include program instructions or computer program code that, when executed by an associated processor, enable the controller 1010 and communication module 1060 to perform tasks as described herein. Additionally, any module such as the communication module 1060 may also include a transceiver configured to allow the same to communicate with another system of a downhole tool.

The modules may be implemented in accordance with hardware (embodied in one or more chips including an integrated circuit such as an application specific integrated circuit), or may be implemented as software or firmware for execution by a processor. In particular, in the case of firmware or software, the exemplary embodiment can be provided as a computer program product including a computer readable medium or storage structure embodying computer program code (i.e., software or firmware) thereon for execution by the processor.

When power is applied to the controller 1010, it executes computer program code to control the valve actuator 1030 that is coupled to the valve mechanism 1040 of the valve assembly. The sensing apparatus 1020 senses when the valve mechanism 1040 is fully actuated and provides a signal to the controller 1010 to control (e.g., alter such as stop) further motion of the valve mechanism 1040. The controller 1010 could either make an open or short circuit on a power line directly coupled to the valve assembly, such as in the communication and powering path 1070. By doing these operations, an operator on the surface can determine when the task of the valve assembly is accomplished. While the scope of the application for the valve assembly is not limited, the valve assembly may be employed in selected ones of the valves illustrated and described with respect to FIGS. 4 and 5 above.

Figure 11:
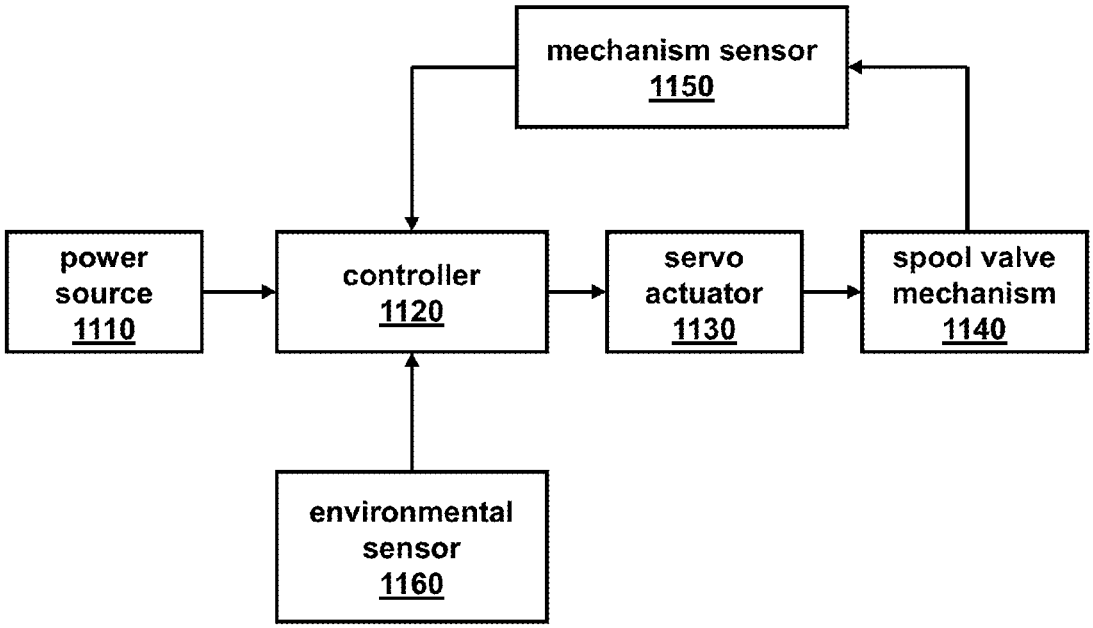

Referring to FIG. 11, illustrated is a schematic view of apparatus according to one or more aspects of the present disclosure. The apparatus includes a valve assembly constructed according to one or more aspects of the present disclosure. The valve assembly includes a spool valve mechanism 1140 that is mechanically coupled to a servo actuator 1130. The servo actuator 1130 is controlled by a controller 1120. A sensing apparatus includes a mechanism sensor 1150 configured to provide a signal to the controller 1120 indicative of a mechanical position of the spool valve mechanism 1140. An environmental feedback signal is also provided to the controller 1120 by an environmental sensor 1160 of the sensing apparatus. Power is provided to the controller 1120 and other modules of the valve assembly by a power source 1110, which may be a battery. While the scope of the application for the valve assembly is not limited, the valve assembly may be employed in selected ones of the valves illustrated and described with respect to FIGS. 4 and 5 above.

Figure 12:
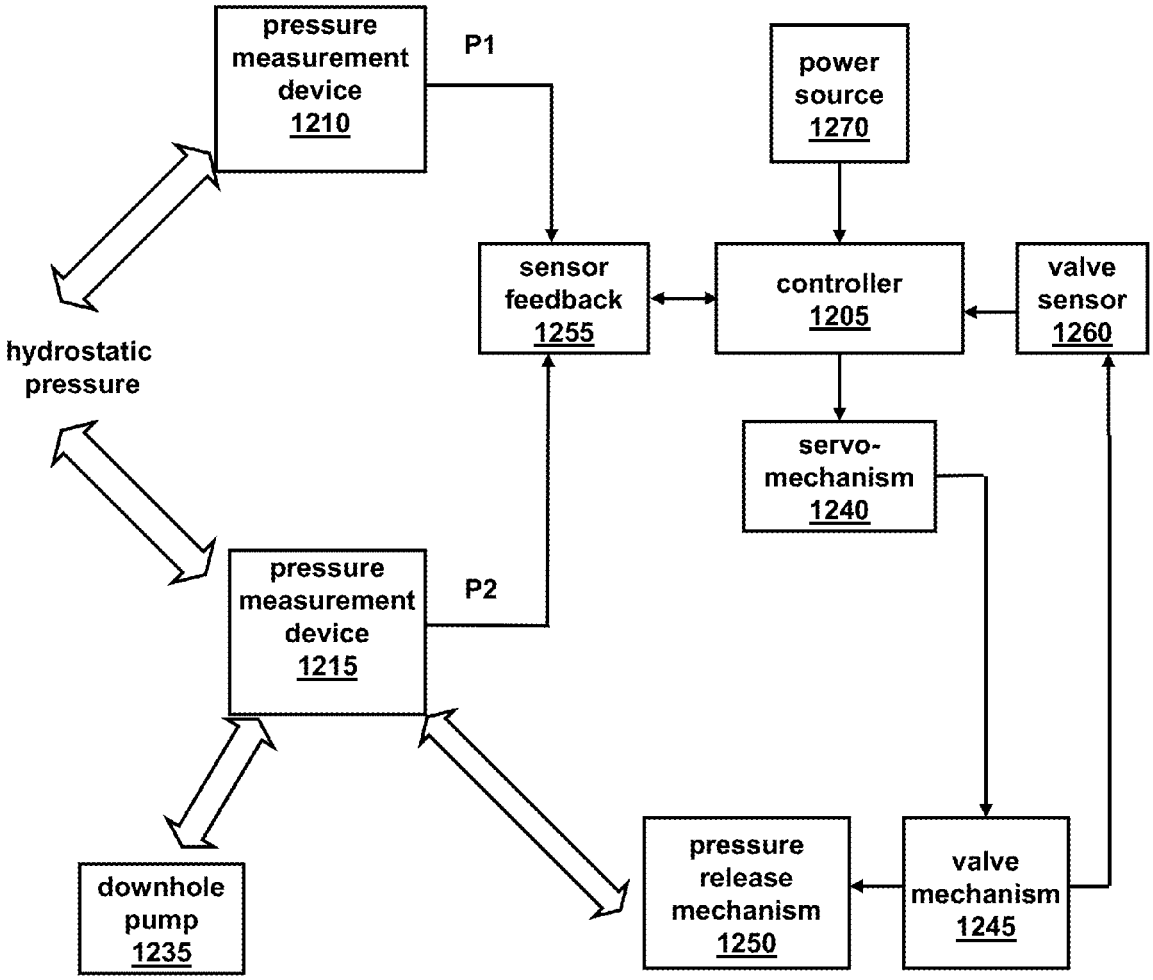

Referring to FIG. 12, illustrated is a schematic view of apparatus according to one or more aspects of the present disclosure. The apparatus includes a valve assembly constructed according to one or more aspects of the present disclosure. A relief valve is an example of the use of independent valve assemblies (or smart valves) and is employed to release fluid that exceeds a maximum pressure allowed inside a downhole tool such as the modular formation dynamics tester ("MDT"). A controller 1205 or other logical device contained in the valve assembly is loaded with software or computer program code that describes a desired pressure for the valve assembly to relieve pressure. In this example, a sensing apparatus includes first and second pressure measurement devices 1210, 1215. The first and second pressure measurement devices 1210, 1215 are subject to the forces of hydrostatic pressure, for example, through one or more pistons. The second pressure measurement device 1215 also senses the pressure applied by a downhole pump 1235. A servomechanism 1240 controls a valve mechanism 1245 that is coupled to a pressure release mechanism 1250 of the valve assembly. The second pressure measurement device 1215 also senses the pressure drop provided by the pressure release mechanism 1250. Thus, when the downhole pump 1235 is not activated, the first and second pressure measurement devices 1210, 1215 may measure the same hydrostatic pressure. When the downhole pump 1235 is activated, the second pressure measurement device 1215 may measure a pressure higher than the hydrostatic pressure. When the pressure release mechanism 1250 is activated, the second pressure measurement device 1215 may measure a pressure lower than when the pressure release mechanism 1250 is not activated. A sensor feedback 1255 provides feedback signals from the first and second pressure measurement devices 1210, 1215 to the controller 1205. The sensor feedback 1255 may include any electronic circuitry or components used to generate the feedback signals. For example, the feedback signal may be a difference between the pressures sensed by the first and second pressure measurement devices 1210, 1215. However, additional or alternate mathematical computations based on the pressures sensed by the first and second pressure measurement devices 1210, 1215 may used to generate the feedback signals. For example, a continuous resistor-capacitor ("R-C") loop that is driven by the outputs from the first and second pressure measurement devices 1210, 1215 may be used to acquire pressure measurements.

If it is desired to release internal module pressure when it reaches 4,000 pounds per square inch ("psi") above hydrostatic pressure (i.e., if $P2 \geq P1+4000$, wherein P1 and P2 represent the pressure sensed by the first and second pressure measurement devices 1210, 1215, respectively), then the servomechanism 1240 activates the valve mechanism 1245, which enables the pressure release mechanism 1250 to relieve the pressure. The controller 1205 can be programmed so that a pressure calculation is performed periodically (e.g., every two milliseconds), which is sufficiently rapid for the pressure release mechanism 1250.

When the controller 1205 causes the servomechanism 1240 to activate the valve mechanism 1245, the valve mechanism 1245 and/or the pressure release mechanism 1250 can be sensed with a sensing apparatus including a valve sensor 1260, and a signal is transmitted back to controller 1205 to provide feedback to assist in positioning the valve mechanism 1245. When the formula $P2 \geq P1+4000$ is not satisfied, the servomechanism 1240 returns back to an original position, closing the pressure relief mechanism 1250. The software or computer program code can be altered depending on the desired pressure to activate the pressure relief mechanism 1250. Power is provided to the controller 1205 and other modules of the valve assembly by a power source 1270, which may be a battery. While the scope of the application for the valve assembly is not limited, the valve assembly may be employed in selected ones of the valves illustrated and described with respect to FIGS. 4 and 5 above.

Figure 13:
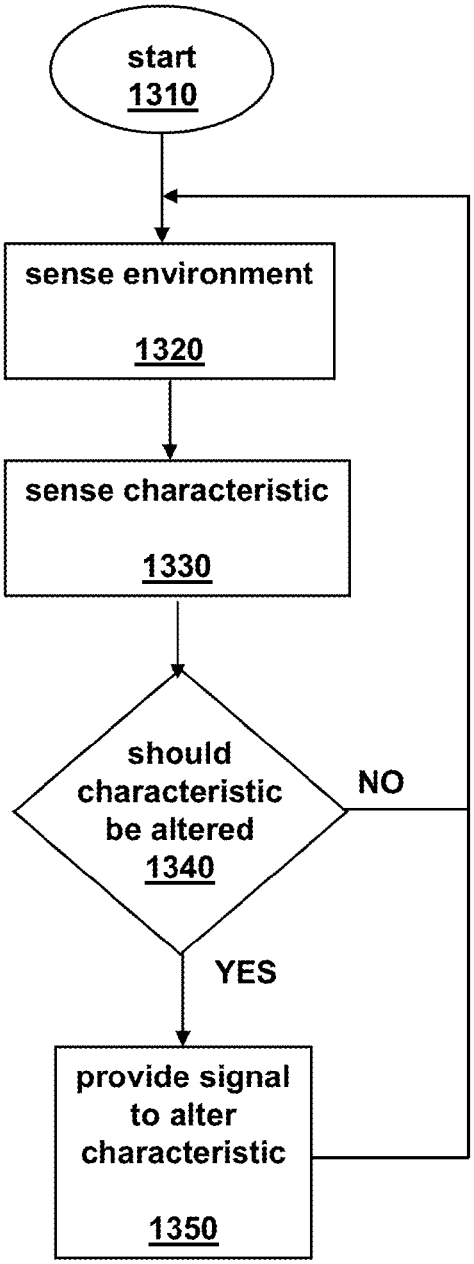
FIG. 13 is a flow chart of at least a portion of a method according to one or more aspects of the present disclosure.

Referring to FIG. 13, illustrated is a flow chart of at least a portion of a method according to one or more aspects of the present disclosure. The method begins in a start step or module 1310. In a sense environment step or module 1320, the method senses a parameter of an environment associated with, but external to, the valve assembly and provides a first signal to a controller in accordance therewith. In a sense characteristic step or module 1330, the method senses a characteristic of the valve assembly and provides a second signal to a controller in accordance therewith. For instance, the method may sense a characteristic of a mechanism of the valve assembly. In a decisional step or module 1340, the controller determines if the characteristic of the valve assembly should be altered or modified in response to the first and second signals. If the characteristic of the valve assembly should not be altered, the method returns to the sense environment step or module 1320. If the characteristic of the valve assembly should be altered, the controller provides a third signal to an actuator to alter the characteristic in response to the first and second signals in a provide signal to alter characteristic step or module 1350. The method then returns to the sense environment step or module 1320. The method is described as continuous to demonstrate the iterative and autonomous nature of the valve assembly. While the scope of the application for the valve assembly is not limited, the method of operating the valve assembly may be employed in selected ones of the valves illustrated and described with respect to FIGS. 4 and 5 above.

Thus, a valve assembly employable with a downhole tool configured for conveyance in a wellbore extending into a subterranean formation and method of operating the same has been introduced herein. In one embodiment, the valve assembly includes an actuator and a sensing apparatus (e.g., including a plurality of sensors) configured to provide a first signal based on an environment associated with the valve assembly (e.g., a parameter of the environment) and a second signal based on a characteristic of the valve assembly (e.g., a characteristic of a mechanism of the valve assembly). The valve assembly also includes a controller configured to provide a third signal to the actuator to alter the characteristic in response to the first and second signals. In accordance with the third signal, the actuator may alter the characteristic of the mechanism of the valve assembly. For instance, the mechanism may be configured to control fluid flow through a drill pipe and the actuator may alter the characteristic of the mechanism to control the fluid flow.

In further alternative embodiments, the downhole tool may include a sample chamber, fluidly coupled to the valve assembly, and configured to sample a subterranean formation and fluid. The valve assembly may include a communication module configured to provide communication between the valve assembly and a surface system via a communication channel. The valve assembly may also include a battery configured to provide power for the controller, the actuator and other elements of the valve assembly. In an exemplary embodiment, the valve assembly is a relief valve assembly employable to release fluid that exceeds a pressure allowed inside of the downhole tool.

In view of all of the above and the FIGUREs, those skilled in the art should readily recognize that the present disclosure introduces an apparatus including a downhole tool configured for conveyance in a wellbore extending into a subterranean formation having a valve assembly. The valve assembly includes an actuator, a sensing apparatus configured to provide a first signal based on an environment associated with the valve assembly and a second signal based on a characteristic of the valve assembly, and a controller configured to provide a third signal to the actuator to alter the characteristic in response to the first and second signals. The second signal may be based on a characteristic of a mechanism of the valve assembly and the actuator may be configured to alter the characteristic of the mechanism. The environment associated with the valve assembly may be external to the valve assembly and the sensing apparatus may include a sensor configured to sense a parameter of the environment. The sensing apparatus may include a first sensor configured to provide the first signal based on the environment associated with the valve assembly and a second sensor configured to provide the second signal based on the characteristic of the valve assembly. The downhole tool may further include a sample chamber configured to sample a subterranean formation fluid, and the valve assembly may be fluidly coupled to the sample chamber. The valve assembly may further include a communication module configured to provide communication between the valve assembly and a surface system via a communication channel. The valve assembly may further include a mechanism configured to control fluid flow through a drill pipe in accordance with the actuator. The valve assembly may further include a battery configured to provide power for the controller and the actuator. The controller and the actuator may be mounted on a printed wiring board.

The controller may include a processor. The controller may include a processor and memory including computer program code, the memory and the computer program code configured to, with the processor, cause the controller to provide the third signal to the actuator to alter the characteristic in response to the first and second signals. The valve assembly may be a relief valve assembly employable to release fluid that exceeds a pressure allowed inside the downhole tool. The downhole tool may further include an upper and lower inflatable packer about an annulus between the downhole tool and a wall of the wellbore and fluidly coupled to the valve assembly. The downhole tool may be configured for conveyance within the wellbore via a wireline or drill string.

The present disclosure also introduces a method of operating a valve assembly in a downhole tool configured for conveyance in a wellbore extending into a subterranean formation. The method includes sensing an environment associated with the valve assembly and providing a first signal based thereon, sensing a characteristic of the valve assembly and providing a second signal based thereon, and providing a third signal to an actuator to alter the characteristic in response to the first and second signals. The second signal may be based on a characteristic of a mechanism of the valve assembly and the method may further include altering the characteristic of the mechanism with the actuator. The environment associated with the valve assembly may be external to the valve assembly and sensing the environment may include sensing a parameter of the environment. The method may further include sampling a characteristic in the subterranean formation. The method may further include providing communication between the valve assembly and a surface computer system via a communication channel.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

What is claimed is:

1. An apparatus, comprising:

a downhole tool configured for conveyance in a wellbore extending into a subterranean formation having a valve assembly, comprising:

an actuator;

a sensing apparatus configured to provide a first signal based on a parameter of an environment associated with the valve assembly and a second signal based on a rotational position of a valve; and a downhole controller in the valve assembly configured to provide a third signal to the actuator to alter the position in response to the first and second signals.

2. The apparatus of claim 1 wherein the parameter of the environment associated with the valve assembly and the sensing apparatus includes a sensor configured to sense a parameter of the environment.

3. The apparatus of claim 1 wherein the sensing apparatus comprises a first sensor configured to provide the first signal and a second sensor configured to provide the second signal.

4. The apparatus of claim 1 wherein the downhole tool further comprises a sample chamber fluidly coupled to the valve assembly and configured to sample the subterranean formation.

5. The apparatus of claim 1 wherein the valve assembly further comprises a communication module configured to provide communication between the valve assembly and a surface system via a communication channel.

6. The apparatus of claim 1 wherein the valve assembly further comprises a mechanism configured to control fluid flow through a drill pipe in accordance with the actuator.

7. The apparatus of claim 1 wherein the valve assembly further comprises a battery configured to provide power for the controller and the actuator.

8. The apparatus of claim 1 wherein the controller are mounted in a printed wiring board.

9. The apparatus of claim 1 wherein the controller comprises a processor.

10. The apparatus of claim 1 wherein the controller comprises a processor and memory including computer program code, the memory and the computer program code configured to, with the processor, cause the controller to provide said third signal to the actuator to alter the position in response to the first and second signals.

11. The apparatus of claim 1 wherein the valve assembly is a relief valve assembly employable to release fluid that exceeds a pressure allowed inside a portion of the downhole tool.

12. The apparatus of claim 1 wherein the downhole tool further comprises an upper and lower inflatable packer about an annulus between the downhole tool and a wall of the wellbore and fluidly coupled to the valve assembly.

13. The apparatus of claim 1 wherein the downhole tool is configured for conveyance within the wellbore via a wireline.

14. The apparatus of claim 1 wherein the downhole tool is configured for conveyance within the wellbore via a drill string.

* * * * *